United States Patent [19]

Kaneko et al.

[11] Patent Number: 4,500,134

[45] Date of Patent: Feb. 19, 1985

[54] DENTAL TREATMENT CHAIR ASSEMBLY

[75] Inventors: Kazuyoshi Kaneko, Tokyo; Jun Tamura, Kyoto, both of Japan

[73] Assignee: Kabushiki Kaisha Morita Seisakusho, Kyoto, Japan

[21] Appl. No.: 404,693

[22] Filed: Aug. 3, 1982

[30] Foreign Application Priority Data

Aug. 14, 1981 [JP] Japan ..... 56-121235[U]

[51] Int. Cl.[3] ..... A47B 83/02

[52] U.S. Cl. ..... 297/170; 108/137; 108/140; 297/173; 297/188; 297/257

[58] Field of Search ..... 297/257, 240, 188, 144, 297/170, 173; 108/102, 106, 140, 141, 137

[56] References Cited

U.S. PATENT DOCUMENTS 1,941,907 1/1934 Martin ..... 297/240

3,712,669 1/1973 Cates ..... 297/188

FOREIGN PATENT DOCUMENTS 2304437 8/1973 Fed. Rep. of Germany ..... 297/188

*Primary Examiner*—William E. Lyddane

*Assistant Examiner*—Mark W. Binder

*Attorney, Agent, or Firm*—Koda and Androlia

[57] ABSTRACT

This disclosure relates to improvements in a dental treatment chair assembly including a unit table having various instruments attached thereto in combination with a unit arm mechanism. The assembly is so constructed that the unit arm mechanism is made slidable in the direction of the mechanism crossing (preferably at right angles with) the body axis of the chair. Such construction makes it possible to meet the convenience of both a doctor and a nurse in their operation of the instruments in dental treatment.

6 Claims, 9 Drawing Figures

DENTAL TREATMENT CHAIR ASSEMBLY

BACKGROUND OF THE INVENTION

1. Field of the Invention

This invention relates generally to a dental treatment chair assembly and more particularly to a dental treatment chair assembly including a unit table having various instruments attached thereto in combination with an arm mechanism, the assembly being designed to meet the convenience of a doctor (dentist) and a nurse (his assistant) in their treatment activities by enlarging the range of operation of the arm mechanism.

2. Prior Art

Japanese Patent Application Open to Public Inspection No. 37297/1975 disclosed a device for giving both to a doctor and to a nurse convenient access to the unit table and removing inconvenience due to positioning of the arm mechanism over the head (belly) of a patient in a crossing relation by fixing the arm mechanism adapted to elevatably and rotatably support the unit table to a base below the backrest of a dental chair so as to permit the free rotation of the arm mechanism, and the device has so far provided convenience in its own way. But this prior art device permits only arcuate movement around one shaft with respect to the base such that the device provides the range of rotation and range of elevation by pivotally jointed segment of each arm, but nevertheless the device does not make it possible for the dentist and the nurses to locate the unit table in a position suitable for them. For example, when the dentist moved from a former position to a new treatment position, and when he desired to move the unit table in the former position horizontally to the new position in exactly the state in which it formerly was, the prior art device made it necessary to position the unit table in the desired position by reactivating the pivotally jointed segments of the arm mechanism.

SUMMARY OF THE INVENTION

This invention has been worked out to make improvements over the above prior art device and is designed to permit free sliding of the arm mechanism inside the cavity of a base, which cavity maintains a cross relation with the body axis of a dental chair and opens in the direction of the head portion of the dental chair.

The dental chair assembly of the invention includes in its preferred form two unit tables for exclusive use by a dentist and a nurse, the tables having a rotatable (and also elevatable) arm attached fixedly or slidably to the base of the dental chair.

Preferred embodiments of the invention will now be described in detail with reference to the accompanying drawings.

DETAILED DESCRIPTION OF THE INVENTION

Figure 1:
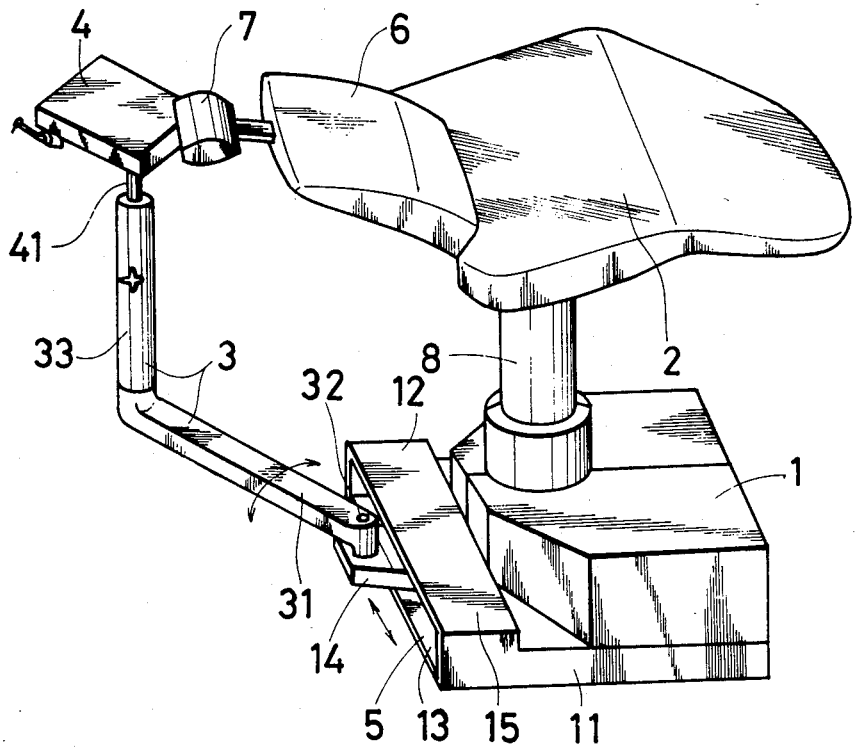
FIG. 1 is a perspective view of a first embodiment of the invention.

The dental treatment chair assembly of the invention includes a dental treatment chair 2 elevatably supported on a base 1 and a unit table 4 elevatably and rotatably supported by an arm mechanism 3, and is characterized in that the arm mechanism 3 is secured to the base 1 so as to permit the sliding of the mechanism within a slot 5 in the base 1, which slot maintains a cross relation with the longitudinal body axis l of the dental chair and opens in the direction of the head portion of the dental chair.

In the drawings, the numeral 6 designates a backrest, 7 designates a headrest, and 8 designates a hydraulic elevating piston. As a concrete means of forming a slot 5 in the base 1 which is connected to a base carrying block 11 to the underside of the base 1, on the front side of the block 11 (on the same side as the headrest 7) is disposed a channel 15 U-shaped in cross section and crossing the body axis l of the dental chair and the cavity of this channel is formed as a slot 5. A slider 14 is slidably mounted inside the slot 5 horizontally and longitudinally of the slot 5. As shown in FIGS. 1 through 6, a base arm 31 of an arm mechanism 3 is supported pivotally through a pin 32 on a sleeve coupling 17 at the front end of the slider 14. The slider 14 includes rollers 16 in rolling contact with the upper and lower walls 12, 13 of the channel 15 and another roller 18 inside a groove 120 formed inside the upper wall 12. The rollers 16 ae freely movable inside the slot 5 under the guidance of the roller 18.

In a first embodiment of the invention shown in FIG. 1, one unit table 4 is attached to a base 1 by an arm mechanism 3. In the arm mechanism 3 a second arm 33 is connected to the upper end of a base arm 31 and a standard 41 supporting the unit table 4 is rotatably and elevatably fitted into the second arm 33. In the embodiment, the slidability of the arm mechanism 3 inside the slot 5 in addition to the elevatable and rotatable movability thereof makes it possible for both the doctor and the nurse to move the unit table 4 to a position suitable for their dental operation and preparation and to use the table 4 in common with each other.

Figure 2:
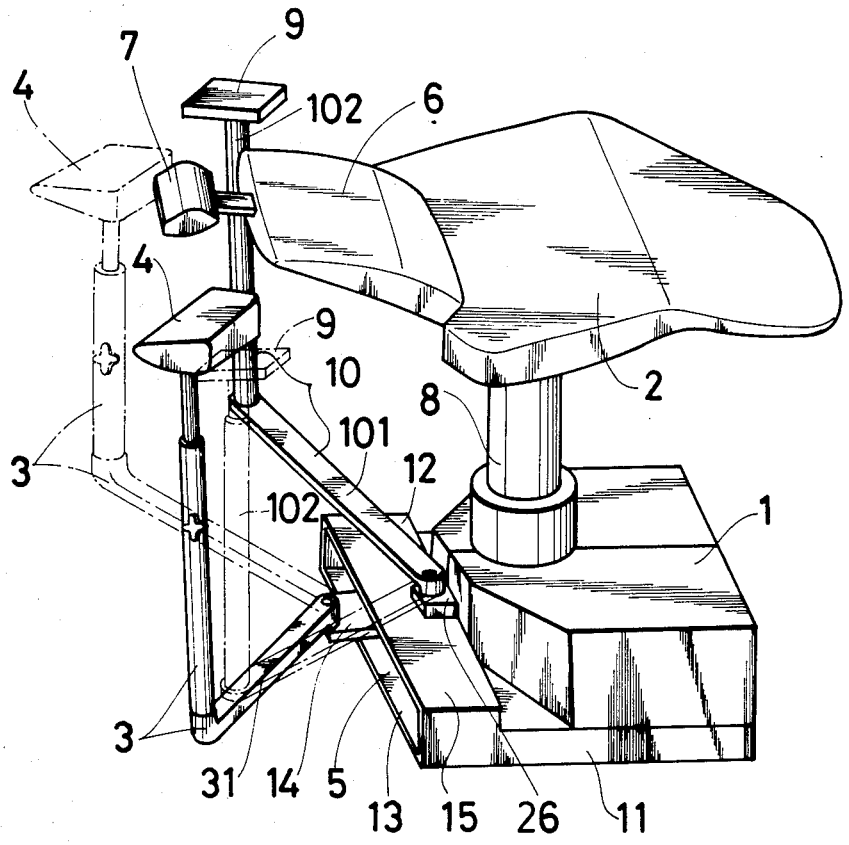
FIG. 2 is a perspective view of a second embodiment of the invention.
Figure 3:
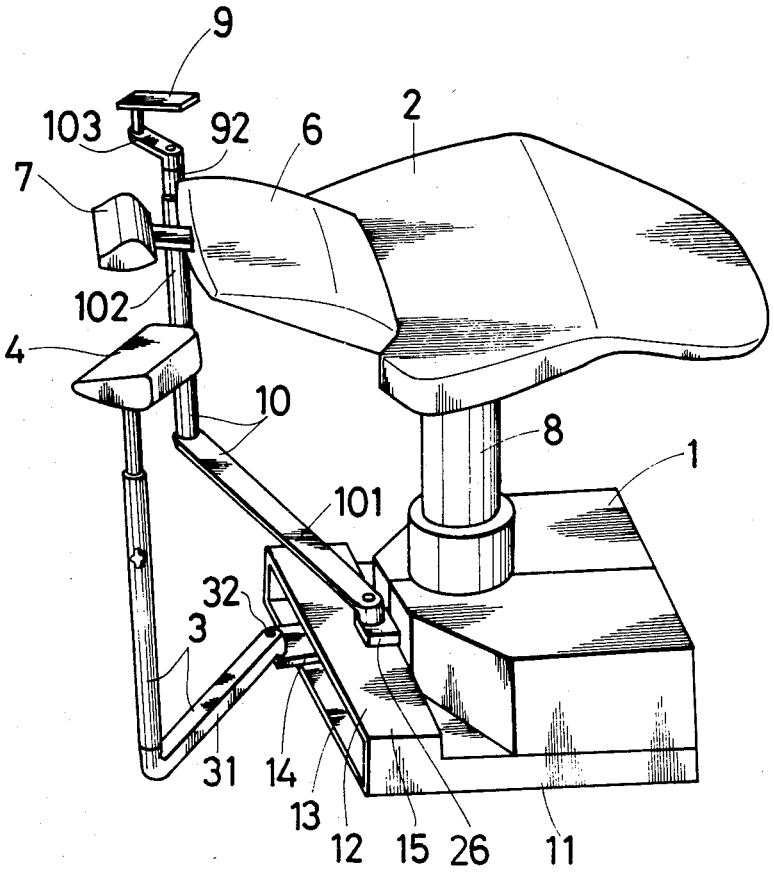
FIG. 3 is a perspective view of a third embodiment.

In a second embodiment shown in FIG. 2, another unit table 9 in addition to the table 4 and an arm mechanism 10 are provided in the manner that the unit table 4 is used exclusively by the doctor and the table 9 by the nurse. A base arm 101 for this arm mechanism 10 is pivotally secured to a projecting block 26 approximately in the middle (directly below the body axis l of the chair) of the base 1. The standard 102 of the table 9 is nonrotatably and nonelevatably fixed to the table 9. The operating position of the unit tables 4 and 9 in the embodiment is shown in one-dotted chain lines in FIG. 2.

A third embodiment is different only at the point in which a swivel arm 103 is added to a standard 92 so as to impart movability in a horizontal plane to the unit table 9 on the nurse side in the second embodiment. The range of operation and the typical arrangement of the unit tables 4 and 9 in the third embodiment are shown in FIG. 8.

Figure 8:
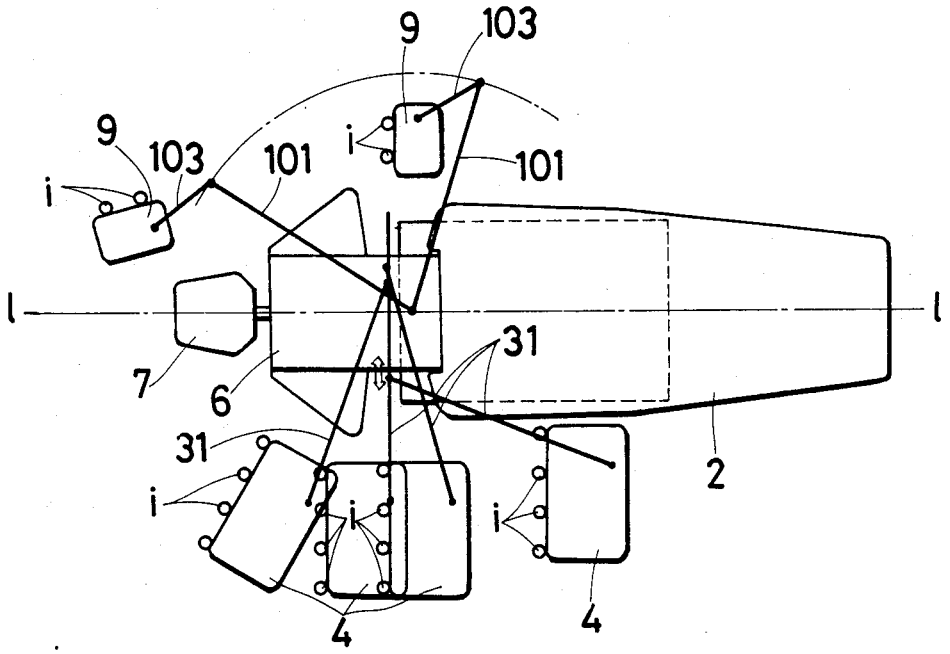
FIG. 8 is a plan view showing how to operate the unit table of the third embodiment wherein the table is designed to be used by a right-handed dentist.
Figure 9:
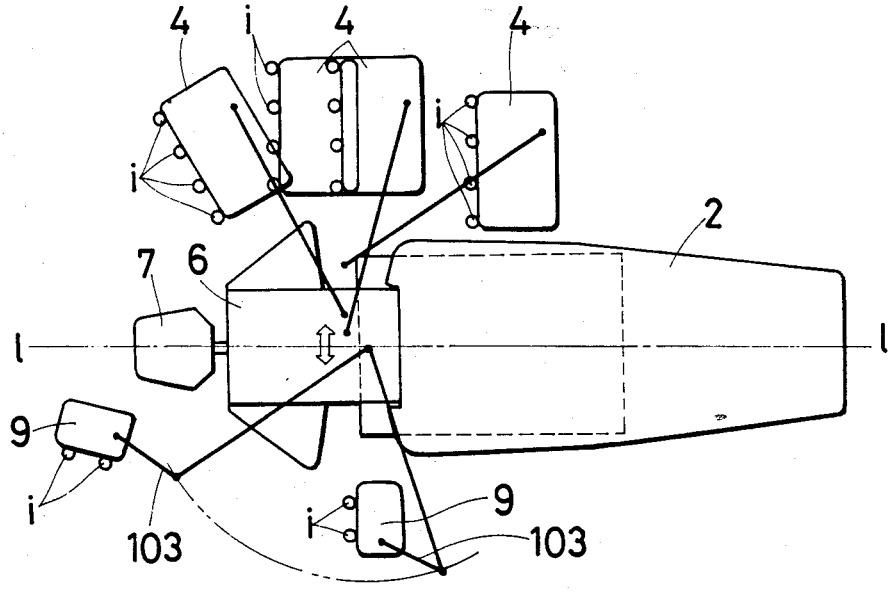
FIG. 9 is a view similar to FIG. 8 but in which the unit table is designed to be used by a left-handed dentist.

It will be understood from FIG. 8 that the table 4 and table 9 have wide applicability for use by doctors (right-handed) and by nurses, respectively. In FIG. 9 is shown an instance wherein the third embodiment is used by a left-handed doctor, the table 9 can be positioned on the right side (upward in FIG. 9) of the chair 2 and the table 9 for the nurse can be positioned on the opposite side. It will be readily understood that the uses of the second and third embodiments shown in FIGS. 8 and 9 may be reverse in order, namely, the second embodiment may be used for a right-handed doctor and the third embodiment may be used for a left-handed doctor. The reference character i in FIGS. 8 and 9 designates a handpiece and other instruments.

Figure 4:
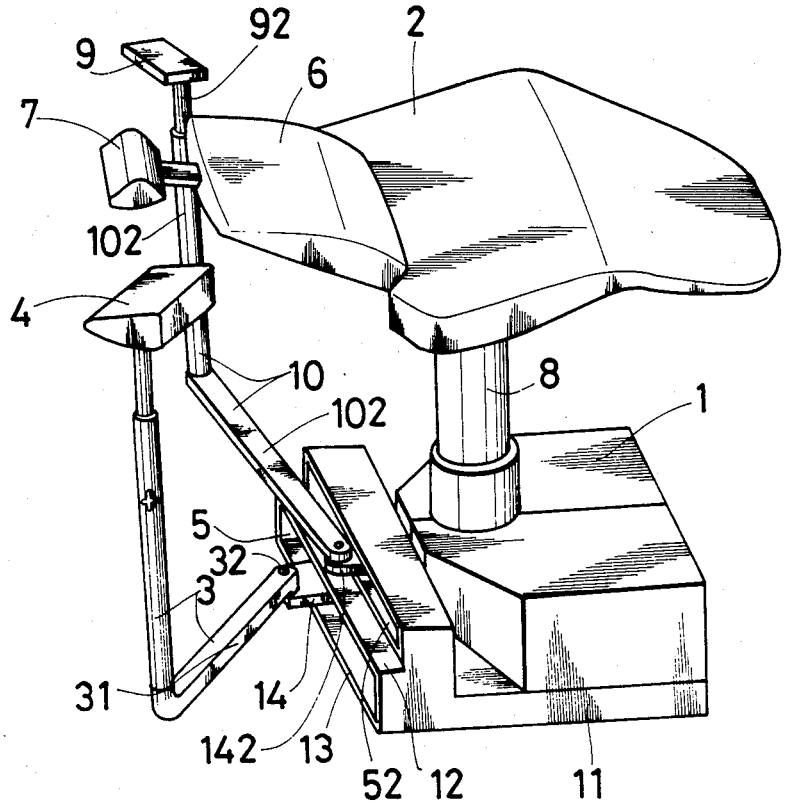
FIG. 4 is a perspective view of a fourth embodiment.

A fourth embodiment as shown in FIG. 4 is different in that in order to impart horizontal rotatability to the unit table 9 in the third embodiment, an arm mechanism 10 is slidably pivoted to the base 1 in the same manner as the arm mechanism 3. Namely, as a slide mechanism with respect to the arm mechanism 10 another slot 52 is formed in a base carrying block 11 in parallel with the slot 5, and a slider 142 is attached to the slot 52 in such a manner that the slider 142 is slidable by the same roller (not shown) as the one described.

The fourth embodiment provides a further advantage in that the arm 103 in the third embodiment can be dispensed with.

Figure 5:
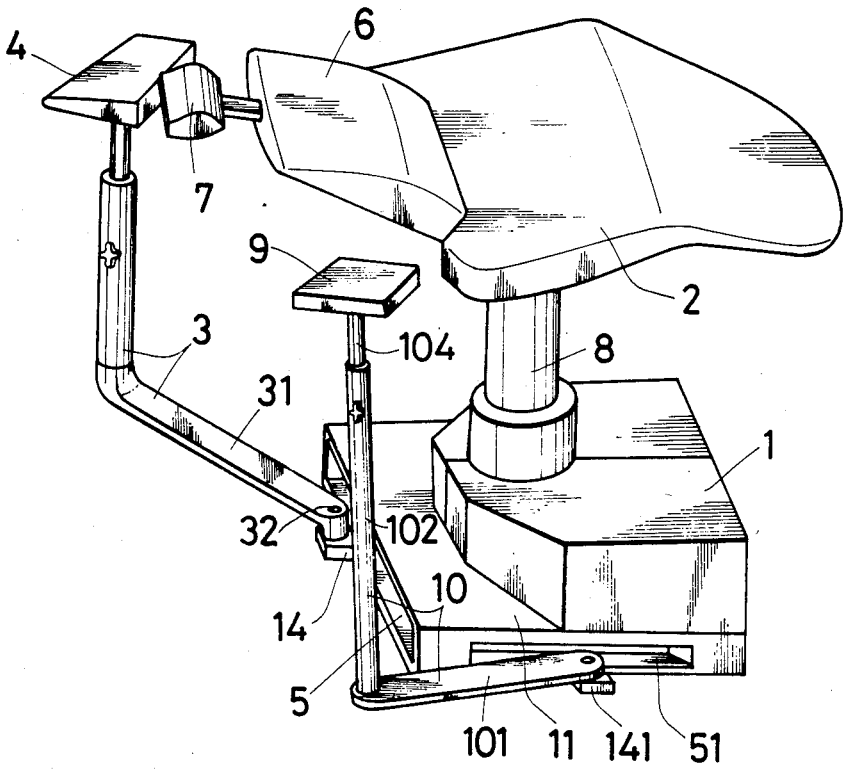
FIG. 5 is a perspective view of a fifth embodiment.
Figure 6:
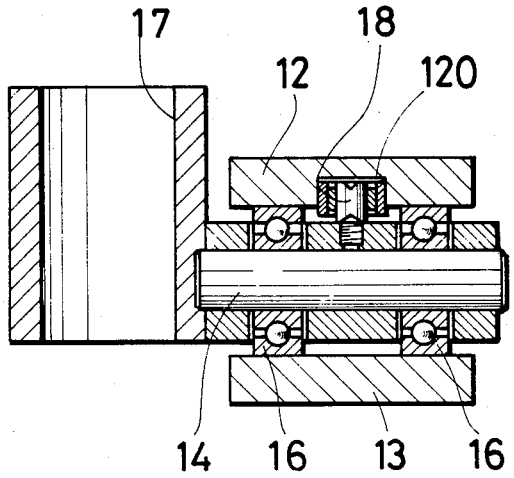
FIG. 6 is a longitudinal sectional side view showing a slide mechanism of a base arm in each of the embodiments above.
Figure 7:
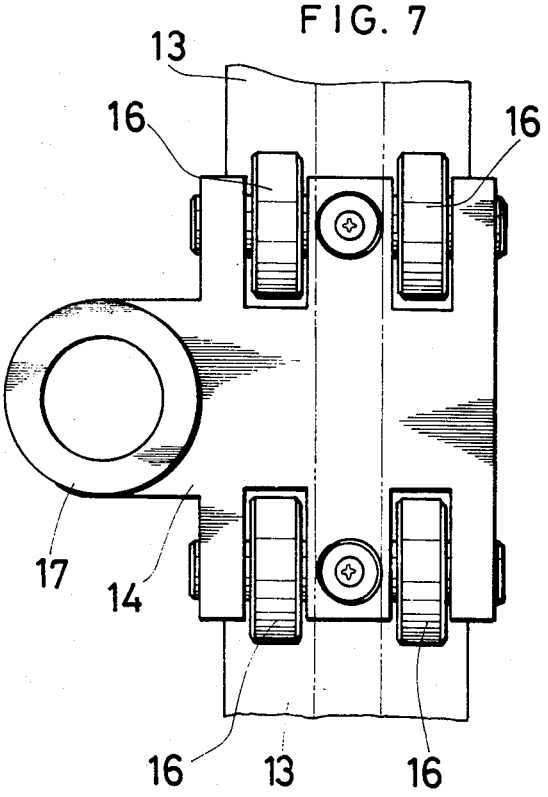
FIG. 7 is a plan view of the slide mechanism with a groove plate excluded.

A fifth embodiment shown in FIG. 5 is different in that, in order to impart both elevatability and horizontal rotatability to the unit table 9 concurrently, the arm 92 is replaced by an arm 104 and in that the arm mechanism 10 is provided slidably with respect to the base 1 in the same manner as the arm mechanism 3.

Namely, the slide mechanism in the fifth embodiment is provided in such a manner that another slot 5, as shown in FIG. 5, is formed in the base carrying block 11 on the side normal to the slot 5, and a slider 141 is slidably mounted in the slot 51 through a roller (not shown) similar to the one described and a base arm 101 is pivoted to the slider 141.

The embodiment shown is based on the premise that the doctor is a left-handed person and the nurse sits on the left side of the chair 2. When the nurse moves forward and backward along the body axis l of the chair 2, the nurse finds it convenient to position the table 9 by use of this arm mechanism 10.

In the embodiments illustrated above, the angle of crossing of the slot 5 with the body axis l has been shown as being orthogonal, but this is a typical case and slight slanting either to the right or left may not be objectionable. Furthermore, although the slot 5 is shown as being formed in the slotted channel 15 of the base carrying block 11, the channel may be replaced by any other suitable member.

As apparent from the description so far given, the invention produces an excellent effect not only in that direct attachment of an arm mechanism supporting the unit table to the base of the dental chair makes it possible to dispense with a separate unit required conventionally independently of the dental chair and makes it unnecessary to suspend an arm mechanism from the ceiling and wall to arrange the mechanism above the chair in a crossing relation but also in that the arm mechanism is more improved in its operatability then the arm mechanism in which the unit table is located in a specified position by the arm mechanism alone by making the arm mechanism slidable within the slot which maintains a cross relation with the body axis l of the dental chair and opens in the direction of the head portion of the dental chair, the improvement in the operatability of the arm mechanism being such that for example, horizontal movability is imparted to meet the convenience of the doctor and the nurse.

It is to be understood that the forms of our invention herein shown and described are to be taken as preferred examples of the same and that various changes in the shape, size and arrangement of parts may be resorted to without departing from the spirit of our invention or the scope of the subjoined claims.

We claim:

1. A dental treatment chair assembly including a dental treatment chair (2) elevatably mounted on a base (1) and a unit table (4) elevatably and rotatably supported by an arm mechanism (3), said assembly being characterized in that said arm mechanism (3) is attached to said base (1) so as to permit the sliding of the arm mechanism (3) within a slot (5) in said base (1), said slot (5) maintaining a cross relation with the longitudinal body axis l of said dental chair and opening in the direction of the head portion of the dental chair.

2. An assembly according to claim 1, further comprising a base carrying block (11) provided on an underside of said base (1) and wherein said slot (5) is a cavity in said base carrying block (11) and is U-shaped in cross-section and connected to the underside of said base (1) and a base arm (31) of said arm mechanism (3) is pivotally attached to a slider (14) slidably mounted inside said slot (5).

3. An assembly according to claim 1 or 2, wherein said arm mechanism (3) crosses said longitudinal body axis l approximately at right angles therewith.

4. An assembly according to claim 1 or 2, wherein an arm mechanism (10) different from said arm mechanism (3) supports another unit table (9) and is directly fixed to the base (1) of said dental treatment chair (2), said unit table (4) is positioned to be used by a doctor and said another unit table (9) is positioned to be used by a nurse.

5. An assembly according to claim 2, wherein an arm mechanism (10) different from said arm mechanism (3) supports another unit table (9) and is slidably pivoted inside a slot (51) formed in the side of said base carrying block (11).

6. An assembly according to claim 3, wherein an arm mechanism (10) different from said arm mechanism (3) supports another unit table (9) and is directly fixed to the base (1) of said dental treatment chair (2), said unit table (4) is positioned to be used a doctor and said another unit (9) is positioned to be used by a nurse.

* * * * *